United States Patent [19]

Sudmeier

[11] Patent Number: 4,730,826

[45] Date of Patent: Mar. 15, 1988

[54] REBOUNDING EXERCISE DEVICE

[76] Inventor: James L. Sudmeier, 56 Village Brook La., #10, Natick, Mass. 01760

[21] Appl. No.: 898,481

[22] Filed: Aug. 21, 1986

[51] Int. Cl.[4] ..... A63B 5/00; A63B 69/18

[52] U.S. Cl. ..... 272/65; 272/97

[58] Field of Search ..... 272/65, 66, 97, 93, 272/109, 144, 70, 100, 101; 273/26 A, 29 A, 407, 410, 411, 181 F, 181 K, 182

[56] References Cited

U.S. PATENT DOCUMENTS

| | | | |
|---|---|---|---|
| 2,590,049 | 3/1952 | Sidlinger | 272/65 |
| 3,767,190 | 10/1973 | Biggerstaff | 272/144 |
| 3,831,935 | 8/1974 | Hofle | 272/97 |
| 4,045,021 | 8/1977 | Nissen | 272/65 |
| 4,376,532 | 3/1983 | Hunstad | 272/97 |
| 4,457,513 | 7/1984 | Thompson | 273/411 |
| 4,483,531 | 11/1984 | Laseman et al. | 272/65 |
| 4,489,941 | 12/1984 | Shieh | 272/65 |
| 4,598,905 | 7/1986 | Vrana | 272/65 |

FOREIGN PATENT DOCUMENTS 1137660 11/1962 Fed. Rep. of Germany ..... 272/65

*Primary Examiner*—Richard J. Apley
*Assistant Examiner*—S. R. Crow
*Attorney, Agent, or Firm*—Robert L. Goldberg; Robert M. Asher

[57] ABSTRACT

A rebounding exercise device is disclosed in which at least two rebounding surfaces are supported at an incline relative to horizontal. The low ends of the rebounding surfaces are near each other so that one can use the rebounding device by jumping from one surface to the other. In particular, the rebounding device includes a mat which is supported in a V shape by a plurality of springs about the periphery of the mat. Loops are provided along the center portion of the mat by which the center portion of the mat can be pulled down so that the V shape is approximately maintained during use.

10 Claims, 9 Drawing Figures

FIG. 1
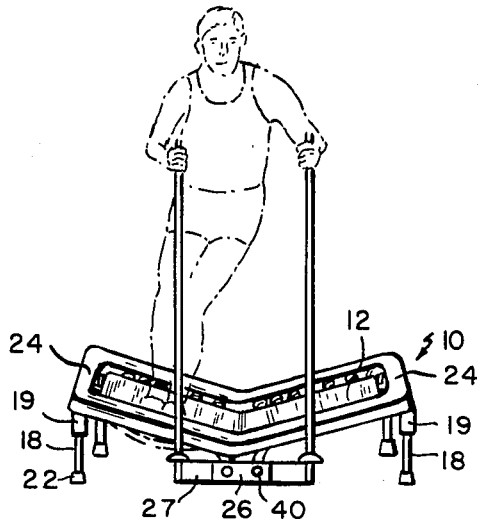
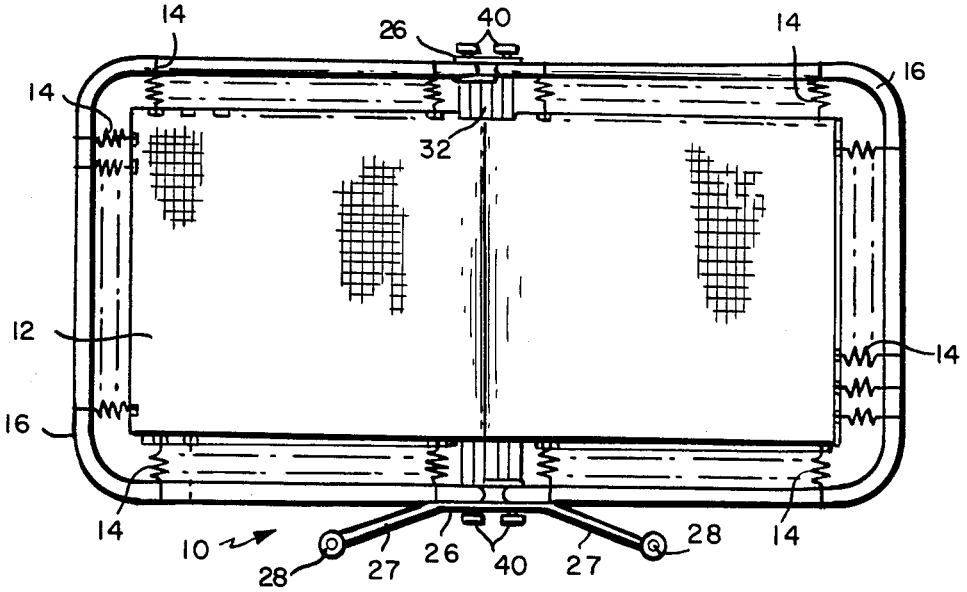
FIG. 2
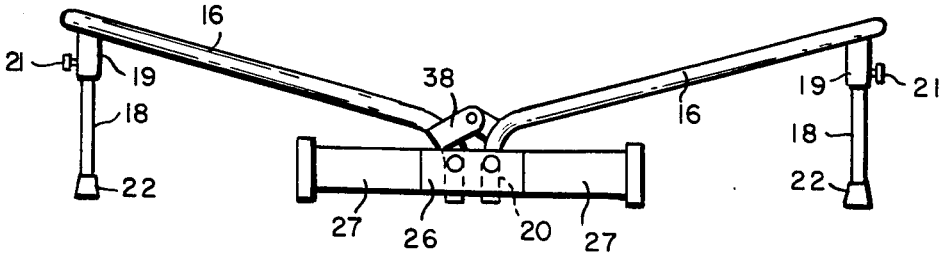
FIG. 3

REBOUNDING EXERCISE DEVICE

BACKGROUND OF THE INVENTION

This invention relates to a rebounding exercise device, in particular one that simulates downhill skiing.

Exercises involving two legged hopping back and forth on the ground have been used in pre-season conditioning classes by ski instructor and coaches for many years. They teach quickness, agility, and the essential up and down weighting coordination used in making linked parallel ski turns. Such exercises build the important leg, arm, stomach, back and buttock muscles used for skiing as well as the kind of heart and lung conditioning used for quick explosive bursts of energy in downhill skiing The disadvantage of these exercises is that they are often performed on a floor by leaping back and forth over a pillow for example. Leaping back and forth on a hard floor causes shock which may cause injuries to the ligaments and joints. It has also been suggested that these exercises be performed on a staircase to obtain more of the realism of downhill skiing, but this would surely increase the risk of injury.

It is an object of the present invention to enable one to perform exercises which strengthen and condition the muscles for use in downhill skiing without causing undue shock to the ligaments and joints.

SUMMARY OF THE INVENTION

This invention is directed to a rebounding exercise device. The device includes at least two inclined rebounding surfaces. The low ends of each incline surface are near each other so that a person using the device can jump back and forth from one rebounding surface to the other. According to one embodiment of the invention, a plurality of springs are attached about a mat to form a rebounding surface. A frame is provided to support the mat at an incline. A hole containing member is attached to the rebounding device to provide holes into which ski poles can be inserted. Thus it is an advantage of the present invention that a person can leap back and forth from one rebounding surface to the other holding on to a pair of ski poles so as to simulate downhill skiing and condition the muscles used when actually snow skiing.

Other objects and advantages of the invention will become apparent during the following description of the presently preferred embodiments of the invention taken in conjunction with the drawings.

BRIEF DESCRIPTION OF THE DRAWINGS

FIG. 1 is a front perspective view of the ski simulator of the present invention in operation.

FIG. 2 is a plan view of the ski simulating device of FIG. 1.

FIG. 3 is a front view of the frame of the ski simulating device of FIG. 1.

DETAILED DESCRIPTION OF THE PREFERRED EMBODIMENTS

Figure 6:
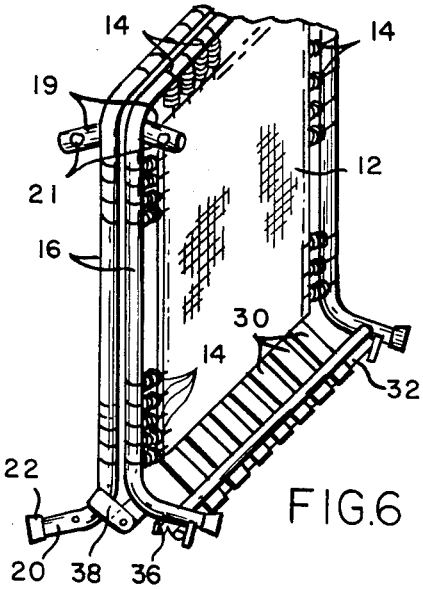
FIG. 6 is a perspective view of the frame with mat and springs of the ski simulating device of FIG. 1 in a folded closed arrangement.

Turning now to the drawings, FIG. 1 illustrates the ski simulating device of the present invention in operation. The ski simulator 10 is a rebounding exercise device. The simulator 10, as shown in FIG. 2, includes a mat 12 which is suspended by a plurality of tension springs 14 from a frame 16. Only some of the springs have been illustrated for the convenience of the drawings. The number of springs used will depend on the size of the rebounding device and the strength of the springs. According to the presently preferred embodiment, ten springs are provided along each end of the frame and along each half of the two sides for a total of sixty springs. The frame 16 is supported by long legs 18 at its outer ends and by short legs 20 in the center portion of the frame 16. The long legs are secured within receptacles 19 of larger diameter by thumbscrews 21. The receptacles 19 are welded to the frame 16. For greater compactness during storage, the legs 18 can be removed as shown in FIG. 6. Non-skid rubber feet 22 are fit onto the bottoms of at least the long legs 18.

A fabric cover 24 may be provided around the periphery of the frame to cover the exposed tension springs 14. The fabric cover 24 has elastic for holding it in place on the frame 16 and is shaped as a hollow rectangle so as to cover the springs 14 but not the mat 12. A locking mount 26 is provided on both sides of the frame 16 to contribute to solidifying the frame structure and keeping the feet level during use. On one side of the frame, the locking mount 26 includes two extension bars 27 each provided with a hole 28 for receiving the tip of a ski pole. Each hole 28 is filled with a rubber lining to allow the ski pole to swivel about when inserted therein.

As shown in FIG. 1, a person trains on the ski simulator 10 by leaping from one inclined portion of the mat 12 to a second inclined portion. The inclined portions face one another thus aiding the user in getting from one side to the other. As presently preferred, each side of the mat is inclined at an angle of about 15° from horizontal. The person on the simulator can hold on to a pair of ski poles, each inserted into a hole 28 to help with balance when leaping from one inclined position to the other.

The frame 16 is now described in greater detail. In the preferred embodiment, the frame 16 is made of two equal sections. Each section of the frame is constructed with four sides to provide strength. The two four-sided sections of the frame 16 each have two corners which are positioned adjacent the other section. The corners are connected to one another by a hinge 38 as seen in FIG. 3. When the frame 16 is fully opened the locking mounts 26 are attached to both sides of the frame 16. Each locking mount 26 is attached to both sections of the frame 16 by a pair of locking screws 40. Once the locking screws 40 are screwed in place, the two locking mounts 26 prevent the two sections of the frame 16 from moving relative to one another.

In accordance with the present invention, the frame 16 holds the rebounding mat 12 in two inclined sections, the low ends of each section being coincident at the center of the mat 12. The invention advantageously provides a mechanism for holding the center of the mat 12 down to provide a fairly even distribution of tension about the four sides of each of the two sections of the mat. This further helps to preserve V shape of the mat formed by the two sections and to cause the two sections to operate somewhat independently of one another.

Figure 4:
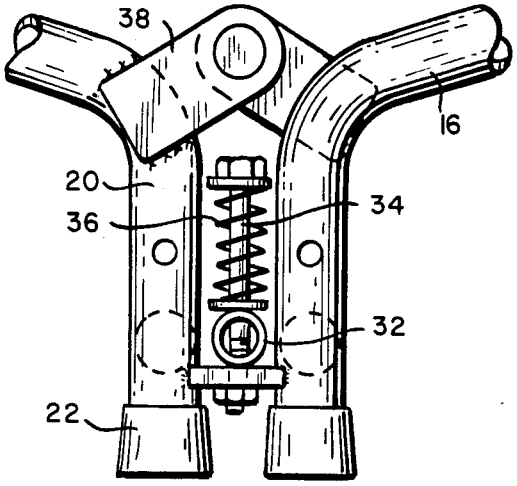
FIG. 4 is a partial front view at the center legs of the frame of the ski simulating device of FIG. 1.
Figure 5:
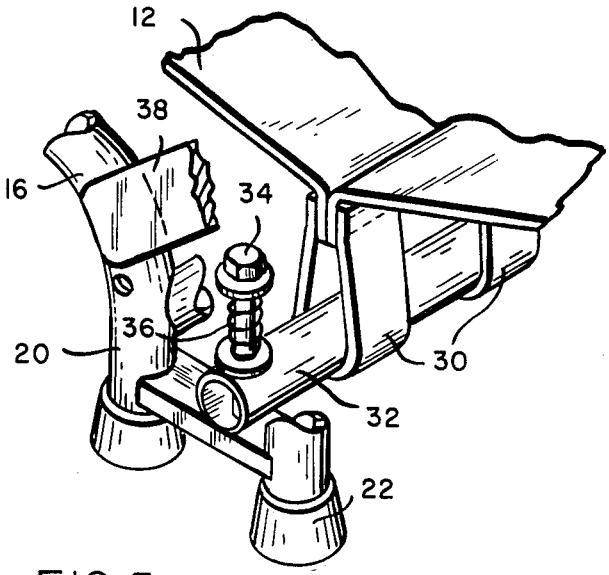
FIG. 5 is a cutaway perspective view of the underside of the ski simulating device of FIG. 1 at the center legs of the frame.

Referring now to FIGS. 4 and 5, the mechanism for holding the center of the mat 12 down is shown. The mat 12 has a series of loops 30 attached in a line across the center of the mat. Each of the loops 30 fits over a center bar 32. The center bar 32 is slidably mounted to a pair of bolts 34, one at each end of the bar. The center bar 32 has a hole at either end through which the bolts 34 are inserted. The center bar 32 is biased downwards by a compression spring 36 on each bolt. The bolts 34 are rigidly attached to the bottom of the short legs 20 of the frame 16. The center bar 32 thus pulls on the loops 30 to hold the center portion of the mat 12 down. As one side of the mat 12 is depressed by a force the center bar 32 pulls the center portion of the mat down thus distributing the tension about all four sides of the depressed mat section. In alternative embodiments, the compression spring can be replaced by rigidly mounting the center bar 32 and making the loops 30 elastic. Another method would be to use smaller loops attached to the center bar 32 by elastic such as a series of bungee cords. It is also possible to remove the elasticity and merely attach the loops 30 to a rigidly mounted center bar 32.

The center bar 32 and compression spring 36 construction serves an additional useful purpose. When the ski simulator 10 of the present invention is shipped or stored, the frame 16 is folded into a closed position as shown in FIG. 6. In the closed position of FIG. 6, the center bar 32 pulls on the loops 30 to hold the frame in its closed position. As one opens the frame 16, the center bar 32 and springs 36 offer resistance until the frame 16 is most of the way open. Thus, the center bar 32 helps maintain the mat's V shape in the open position and helps keep the frame 16 closed when it is in the closed position.

Figure 7:
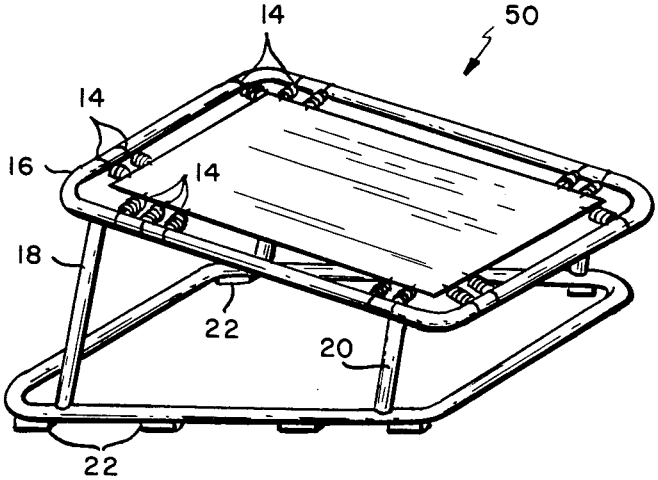
FIG. 7 is a perspective view of an inclined rebounding mat module of an alternative embodiment of the present invention.
Figure 8:
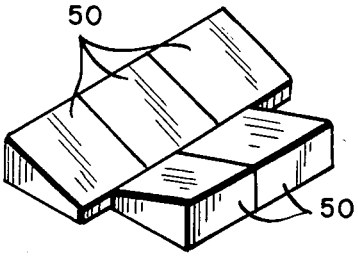
FIG. 8 illustrates one embodiment for combining the modules of FIG. 7 to simulate a tire course.
Figure 9:
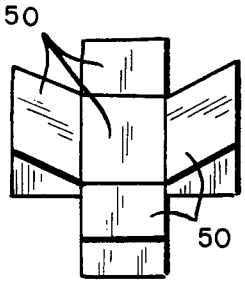
FIG. 9 illustrates a second arrangement of modules of FIG. 7.

A simplified modular version of the rebounding device of the present invention is shown in FIG. 7. As shown in FIG. 7, a rebounding module 50 includes a mat 12 supported at an incline by a frame 16. Tension springs 14 hold the mat to the frame 16. Non-skid rubber feet 22 are provided at the bottom of the frame 16. When provided with a plurality of rebounding modules 50, they may be arranged in any variety of configurations to enable a number of different exercises and games to be performed on them. The rebounding modules arranged in a configuration can be held together by any conventional tying mechanism. It is preferred that the low ends of the modules 50 be closer to each other than the high ends so that the force of a rebounding module 50 can be used by a person to propel the person from one module in the direction of another module. In FIG. 8 the rebounding modules 50 are aligned in a configuration which simulates the exercise of running through a series of tires. According to FIG. 9, a second configuration is shown in which four rebounding modules 50 are arranged about a horizontal rebounder or trampoline. The low ends of each of the rebounding modules 50 adjoin the horizontal rebounder 60. This configuration can be used to play a game in which each of the rebounders is numbered and the numbers are randomly selected instructing a player to bounce from one rebounder to the next selected rebounder. The rebounding modules in these configurations can be held together by any conventional tying mechanism.

Of course, it should be understood that various changes and modifications to the preferred embodiments described above will be apparent to those skilled in the art. For example, bungee cords may be substituted for the tension springs 14. Similarly bungee cords can be used to attach the center portion of the mat 12 to a center bar which is secured down beneath the mat 12. These and other changes can be made without departing from the spirit and the scope of the invention and without diminishing its attendant advantages. It is therefore intended that such changes and modifications be covered by the following claims.

I claim:

1. A rebounding exercise device comprising:

mat means;

a plurality of springs attached about the periphery of said mat means, each spring having an outer end extending from said mat means;

a frame to which the outer ends of said plurality of springs are attached, said frame having a low center portion and two high ends at opposite ends of said frame, such that said mat means is formed with a low center portion and two inclined portions when supported by said frame so that a person may jump back and forth on said two portions; and means attached to the low center portion of said mat means for pulling said low portion of said mat means down.

2. The rebounding device of claim 1 further comprising two members extending from said device, each member containing a rubber lined hole so that one end of a ski pole may be inserted into said hole and a handle portion of said ski pole may be held by a person while jumping on said rebounding device.

3. The rebouding device of claim 1 further comprising non-skid pads attached to the bottom of said frame to prevent said device from sliding when in use.

4. The rebounding device of claim 1 wherein said pulling means comprises a bar connected to said frame beneath said mat means and connected to the underside of said mat means along its low center portion.

5. The rebounding device of claim 1 wherein said mat means is inclined at about 15° from horizontal on each side of the low center portion.

6. The rebounding device of claim 1 wherein said frame further includes hinge means for making said frame collapsible and so that when in a collapsed position said frame is held closed by said pulling means attached to the low center portion of said mat.

7. A ski rebounding device comprising:

a first rebounding surface;

first means for supporting said first surface at an incline relative to a horizontal plane so that said surface has a low end and a high outer end;

a second rebounding surface;

second means for supporting said second surface at an incline relative to horizontal so that said second surface has a low end and a high outer end, said first and second surfaces being located with the low ends of said surfaces in between the high outer ends of said surfaces means attached to the low ends of said surfaces for pulling said low ends of said surfaces down; and two members extending from said device, each member containing a rubber lined hole so that one end of a ski pole may be inserted into said hole and a handle portion of said ski pole may be held by a person while jumping on said rebounding device.

8. The ski simulating device of claim 7 further comprising hinge means connected between said first supporting means and said second supporting means for making said rebounding device collapsible for easy storage.

9. The ski simulating device of claim 7 further comprising non skid pads attached to the bottom of said first supproting means and said second supporting means to prevent said device from sliding when in use.

10. The ski simulating device of claim 7 wherein the inclines of said first and second surfaces are each about 15° from horizontal.

* * * * *